United States Patent [19]

Nagati

[11] 4,275,871

[45] Jun. 30, 1981

[54] METALLURGICAL VESSEL AND SUPPORTING MEANS

[75] Inventor: Rashed N. Nagati, Mars, Pa.

[73] Assignee: Pennsylvania Engineering Corporation, Pittsburgh, Pa.

[21] Appl. No.: 169,965

[22] Filed: Jul. 18, 1980

[51] Int. Cl.[3] ..... C21C 5/46

[52] U.S. Cl. ..... 266/243; 266/244; 266/245; 266/246; 266/247

[58] Field of Search ..... 266/243–247

[56] References Cited

U.S. PATENT DOCUMENTS

| | | | |
|---|---|---|---|
| 3,502,314 | 3/1970 | Puhringer | 266/246 |
| 3,711,077 | 1/1973 | Nagati | 266/246 |
| 3,713,638 | 1/1973 | Langmead | 266/246 |
| 3,756,583 | 9/1973 | Nagati | 266/246 |
| 3,797,815 | 3/1974 | Seki | 266/246 |
| 3,799,527 | 3/1974 | Fisher | 266/246 |
| 4,047,708 | 9/1977 | Lee | 266/243 |
| 4,061,318 | 12/1977 | Fisher | 266/246 |
| 4,121,811 | 10/1978 | Fisher | 266/246 |

*Primary Examiner*—P. D. Rosenberg

[57] ABSTRACT

A metallurgical vessel has upper and lower brackets which engage a trunnion ring for support along inclined surfaces whose total vertical angle has a tangent equal to the growth of the vessel radially in the region of its said brackets to the elongation of that portion of the vessel between the brackets.

10 Claims, 9 Drawing Figures

METALLURGICAL VESSEL AND SUPPORTING MEANS

BACKGROUND OF THE INVENTION

A typical metallurgical vessel of the pneumatic type wherein air or oxygen is projected into a molten metal bath generally includes a dished bottom section, a conical upper end and a generally cylindrical central section. Such vessels are commonly supported on a trunnion ring which permits the vessels to be tilted between various operative positions. Trunnion rings are typically water-cooled and are engaged by brackets affixed to the vessel surface. In order to support the vessel in both upright and tilted positions, vessel support systems generally include brackets which engage both the upper and lower surface of the trunnion ring.

Metallurgical vessels of the pneumatic type, such as those employed in basic oxygen processes, are subjected to deformation resulting from conditions encountered during a typical metallurgical operation. Such vessels are generally lined with refractory brick and contain molten metal and slag. The injection of oxygen and fluxes into the vessel produces exothermic reactions resulting in the generation of substantial heat which in turn elevates the temperature of the molten metal and the vessel itself. The inside surface of the refractory brick lining has the highest temperature which is substantially equal to that of the molten metal bath or the effluent gases. A temperature gradient also exists between the inner and outer surfaces of the refractory lining such that the outside temperature of the vessel shell may be several thousand degrees F. lower in temperature than the inside surface of the furnace lining. Nevertheless, the steel shell of the vessel is at a relatively elevated temperature of several hundred degrees F. These relative inner and outer surface temperatures vary during the life of a vessel as a result of changes in refractory thickness caused by wear and surface erosion.

As a result of these thermal stresses, the vessel will grow longitudinally and radially. Trunnion rings, on the other hand, are generally water-cooled and may therefore be several hundred degrees cooler than the surface of the vessel shell. As a result, thermal expansion of the trunnion ring will be relatively insignificant in relation to that of the vessel. Unless means are provided to permit differential expansion of the vessel relative to the trunnion ring, undue stresses will be induced in the vessel surface, the support brackets or in the trunnion ring itself.

DESCRIPTION OF THE PRIOR ART

U.S. Pat. Nos. 3,191,921; 3,337,205; and 3,502,314 all disclose vessel support systems wherein the vessel brackets engage the trunnion ring support along inclined planes whose angles are related to the distance between the upper and lower support brackets and the outer radius of the vessel. This angular relation is based upon the assumption that the relative expansion of the vessel will be uniform in both the longitudinal and radial directions. However, in actual practice this has been found not to be the case. For this reason, U.S. Pat. No. 3,337,205 provides a slight degree of clearance between inclined surfaces on the vessel brackets and those on the trunnion ring.

SUMMARY OF THE INVENTION

It is an object of the invention to provide a new and improved support system for metallurgical vessels.

Another object of the invention is to provide a support system for metallurgical vessels wherein stresses resulting from differential thermal expansion are minimized.

These and other objects and advantages of the present invention will become more apparent from the detailed description thereof taken with the accompanying drawings.

In general terms the invention comprises a metallurgical vessel having brackets which engage for support at least one surface of the trunnion ring along an inclined surface whose angle corresponds to the path that the adjacent portion of the vessel surface will move during thermal expansion and contraction. This angle is a function of the initial outside radius of the vessel at room temperature, the actual thickness of the vessel shell, the temperature of the shell at the adjacent surface during operation, the ambient temperature in the area surrounding the vessel, modulist of elasticity, the coefficient of linear expansion of the steel shell, and the effective distance between the upper and lower support brackets.

DETAILED DESCRIPTION OF THE PREFERRED EMBODIMENTS

Figure 1:
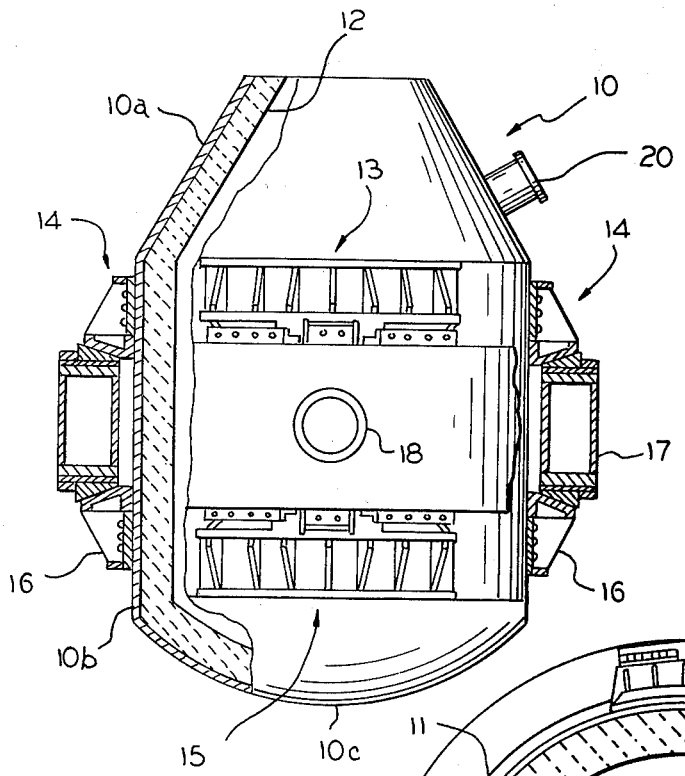
FIG. 1 is a front elevational view, partly in section, of metallurgical vessel having support means according to the present invention.

The invention will be illustrated in connection with a vessel 10 shown in FIGS. 1 and 2 to have a conical upper end 10*a*, a cylindrical center section 10*b* and a dished bottom 10*c*. Vessel 10 is defined by shell 11 of a metallic material such as steel and a refractory lining 12. A plurality of upper and lower support assemblies 13, 14, 15 and 16 secure vessel 10 to a trunnion ring 17. Trunnions 18 extend from each of the opposite sides of trunnion ring 17 and each is supported in a well-known manner on bearing structures (not shown). One of the trunnion pins 18 is also coupled to a suitable drive assembly (not shown) for tilting the vessel 10 to various positions to permit charging, deslaging, sampling, temperature measurement, or the discharge of hot metal through a pouring spout 20.

Figure 2:
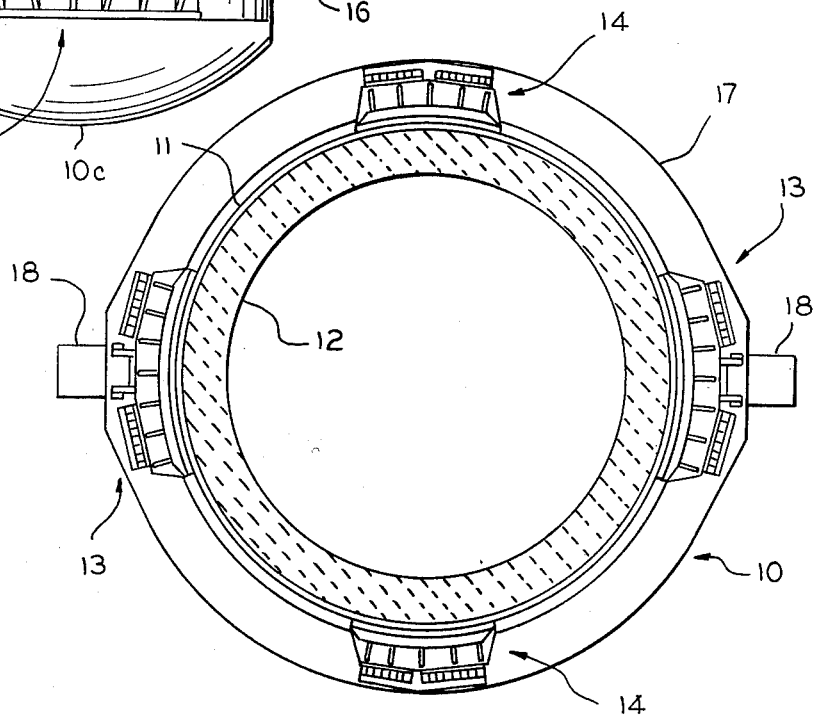
FIG. 2 is a top plan view, partly in section, of the vessel illustrated in FIG. 1.

While the preferred embodiment of the invention is shown in FIGS. 1 and 2 to include two each of the upper suspension assemblies 13 and 14 and the lower assemblies 15 and 16, the actual number of each will be covered by the size and weight of the vessel 10 being supported. Preferably, the upper and lower assemblies are spaced equiangularly around the vessel, which in the case of four assemblies this spacement would be at radial angles of substantially 90°.

Figure 4:
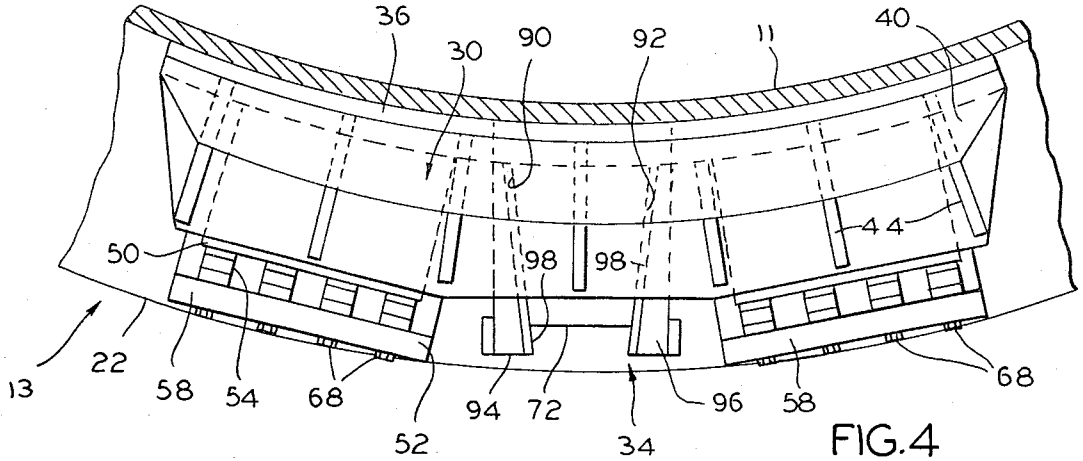
FIG. 4 is a top plan view of the support assembly shown in FIG. 3.
Figure 5:
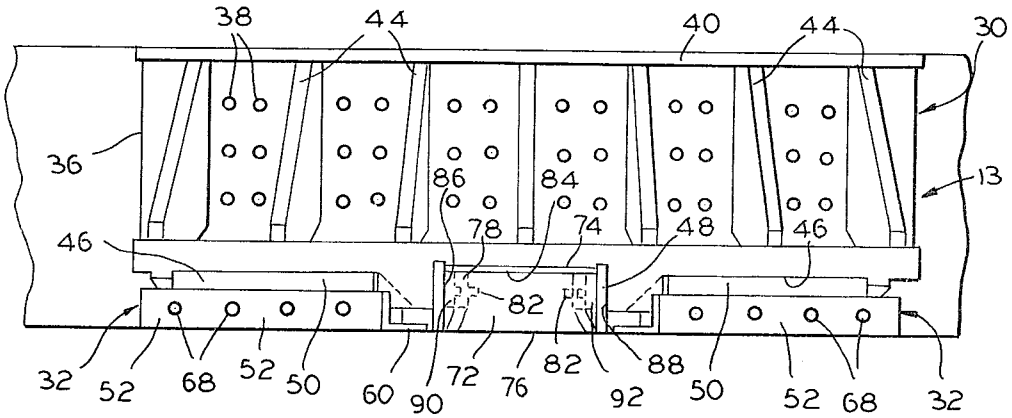
FIG. 5 is a front view of the support assembly of FIG. 3.
Figure 3:
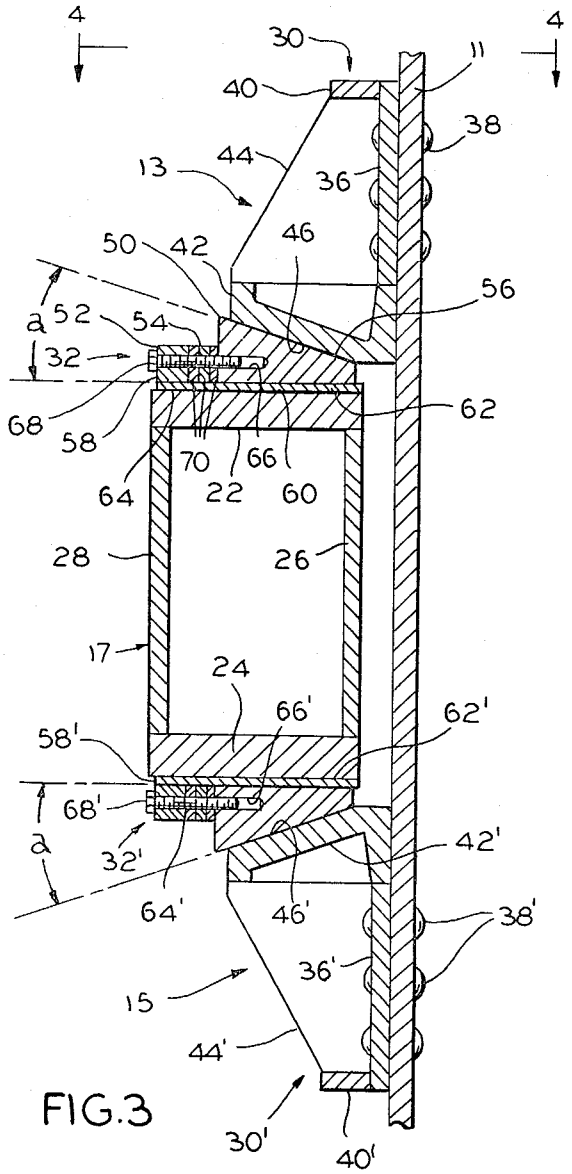
FIG. 3 is an enlarged view of one of the support assemblies of the vessel of FIG. 1.

The trunnion ring 17 is shown in FIG. 3 to be comprised of upper and lower flanges 22 and 24 and inner and outer wrappers 26 and 28 which are joined to form a generally hollow, annular assembly through which cooling water may be circulated in a manner well known in the art. As seen in FIGS. 3–5, the upper suspension assembly 15 includes a bracket 30 and a pair of support wedges 32 disposed between the bracket 30 and the trunnion ring 16. Disposed between the support wedges 32 is a stop block assembly 34 constructed and arranged to prevent relative rotational movement between the vessel 10 and trunnion ring 16.

The bracket 30 includes a curved mounting plate 36 whose inner surface conforms generally to that of the shell 11 and to which it is secured by means of a plurality of bolts or rivets 38 extending through suitable openings formed in plate 36 and shell 11 of vessel 10. Bracket 30 also includes a top flange 40 which extends radially relative to vessel 10 and a bottom plate 42 extends obliquely upwardly and whose lower surface is configured for engaging the wedge assemblies 32 and the stop block assembly 34. A plurality of ribs 44 are affixed to the mounting plate 30, the top bracket 40, and the bottom plate 42 and are suitably affixed thereto in any suitable manner, such as by welding.

Formed in the undersurface of bottom plate 42 are a pair of inclined surfaces 46 for engaging the wedge assemblies 32 and a central recess 48 for receiving the stop block assembly 34. Each of the wedge support assemblies 32 includes a wedge block 50, an anchor block 52, and wedge spacers 54. Wedge block 50 is generally triangular in vertical cross-section and has an inclined upper surface 56 which is complementary to the surface 46 formed on bottom plate 42. The anchor block 52 is suitably affixed to the upper trunnion ring flange 22 such as by welding and includes an enlarged head portion 58 disposed adjacent the outside edge and a plate-like portion 60 extending inwardly therefrom toward the vessel which forms a wearplate between wedge block 50 and flange 22. The lower surface 62 of wedge block 50 extends generally radially of vessel 10 for engaging the generally planar wearplate 60. A plurality of radial openings 64 are formed in the head 58 of anchor block 52 and each is aligned with one of a plurality of threaded holes 66 formed generally radially in wedge block 50. Extending through each of the openings 64 and into one of the threaded holes 66 is an adjustment bolt 68 whereby rotation of the bolt 68 will move wedge blocks 50 in a radially direction relative to the vessel 10. Disposed in the gap between anchor block 52 and wedge block 50 are the plurality of space elements 54.

The stop block assembly 34 includes a stop block 72 affixed to the upper trunnion ring flange 22 within the recess 48 between wedge block assemblies 32. The stop block 72 is generally rectangular in vertical cross-section and includes generally parallel upper and lower surfaces 74 and 76. The side surfaces 78 and 80 of block 72 slant inwardly from the end thereof adjacent the vessel and each has a longitudinally extending groove 82 extending in a generally parallel relation to the upper and lower surfaces 74 and 76. The recess 48 is also generally rectangular in vertical cross-section and has an upper surface 84 spaced a slight distance from the upper surface 74 of block 72 and a pair of side surfaces 86 and 88 which are spaced from the surfaces 78 and 80 of block 72 and converge at a smaller angle. This provides a pair of outwardly divergent wedge-shaped gaps 90 and 92 between the sides of block 72 and recess 48. Disposed in gaps 90 and 92, respectively, are wedges 94 and 96 which are shown in FIG. 4 but omitted from FIG. 3 for purposes of illustration. Each of the wedges 94 and 96 is provided with a tongue 98 which is received on one of the associated grooves 82 formed in block 72. When the wedges 94 and 96 are in position, relative rotational movement between vessel 10 and trunnion ring 16 is prevented.

The lower support assembly 15 is a mirror image of the upper support assembly 13 and accordingly will not be described in detail. However, corresponding parts of the lower bracket assembly 15 have been given the identical reference numerals as those employed to describe the upper bracket assembly 13 except that each has been distinguished by a prime (') in FIG. 3.

Figure 6:
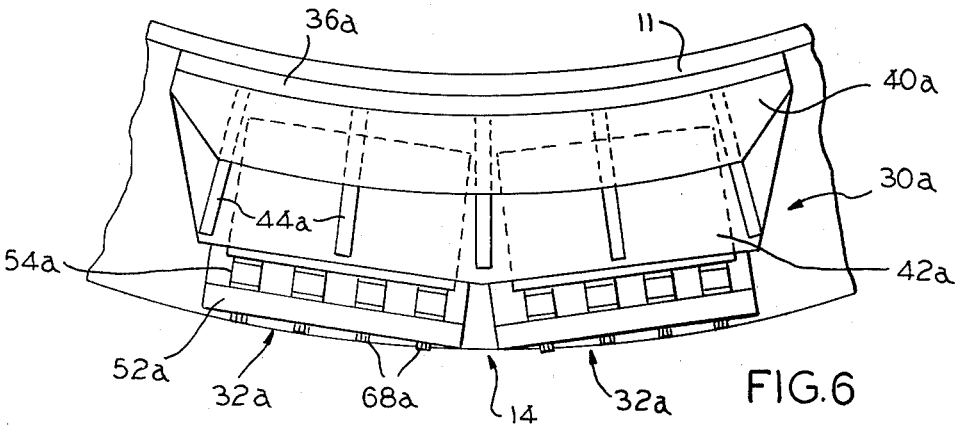
FIG. 6 is a bottom view of another one of the support assemblies of the vessel of FIG. 1.

The upper bracket assemblies 14 are similar to the bracket assemblies 13 as seen in FIG. 6 except that the stop block portion has been eliminated thereby compressing the bracket 30*a*. However, brackets 30*a* and the wedge block assemblies 32*a* are otherwise identical to those illustrated in FIGS. 3–5 and accordingly will not be discussed in detail. Similarly, the lower bracket assemblies 16 which are disposed immediately below brackets 14 are mirror images thereof and accordingly will also not be discussed in detail. Corresponding parts of the assembly 14 are identified in FIG. 6 with the same reference numerals as used in FIGS. 3–5 in relation to assemblies 13 and 15 except that each of the former has been distinguished by the letter (a).

Figure 8:
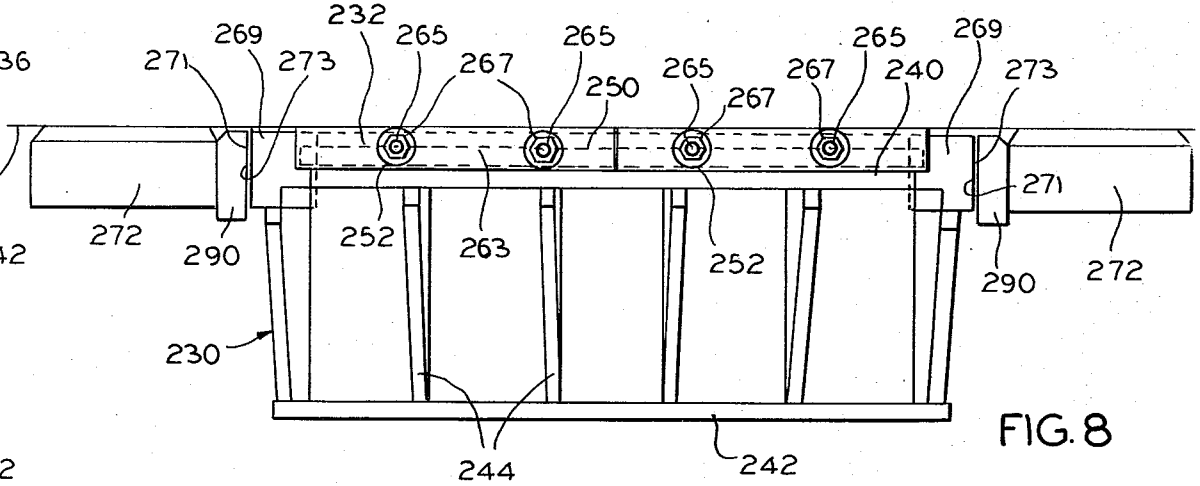
FIG. 8 is a front view of the support assembly shown in FIG. 7.
Figure 9:
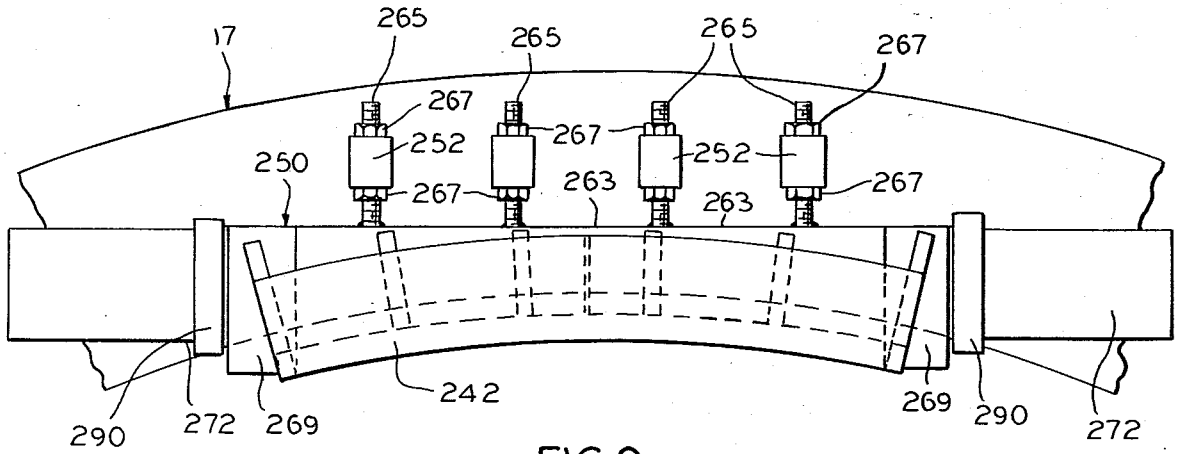
FIG. 9 is a bottom view of the support assembly shown in FIG. 7.
Figure 7:
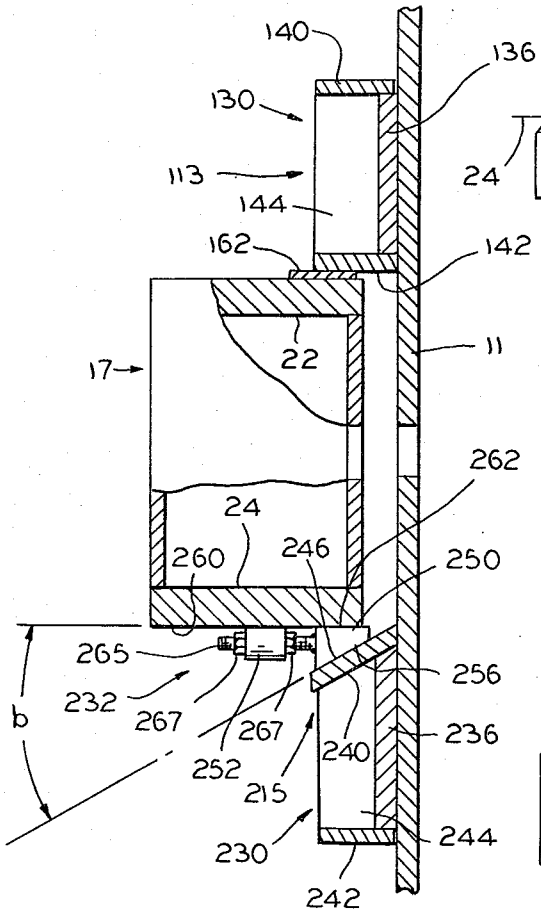
FIG. 7 is a cross-sectional view of an alternate embodiment of the support assembly according to the present invention.

FIGS. 7–9 show an alternate embodiment of the present invention which differs from that shown in FIGS. 1–6 in two respects. Firstly, the upper bracket assembly 113 engages the trunnion ring 17 along a generally radial plane so that a wedge assembly 232 is provided only between the lower bracket 230 and the lower trunnion ring flange 24. Further, the wedge block assembly 232 of the embodiment of FIGS. 7–9 is specifically different from that of FIGS. 1–7. In particular, the upper bracket 130 is generally U-shaped in vertical cross-section and includes a curved mounting plate 136 conforming to the adjacent surface of the vessel 10 and radially extending upper and lower flanges 140 and 142 which are interconnected by ribs 144. As in the embodiment of FIGS. 1–7, the bracket 130 is suitably affixed to the vessel shell 11. Disposed between the lower bracket flange 142 and the upper trunnion ring flange 122 is a wearplate 162.

The lower bracket 230 also includes a curved mounting plate 236 suitably affixed to vessel 11 and upper and lower flanges 240 and 242, respectively, and which are interconnected by ribs 244. The upper bracket 240 is shown in FIG. 7 to be inclined downwardly and away from the vessel 10 with its upper surface 246 being a section of a frusto-cone although curved only to a slight degree.

The wedge block 250 comprises an elongate member disposed between the lower trunnion ring flange 24 and the upper flange 240 of bracket 230. The lower surface 256 of block 250 is complementary to the surface 246 of flange 240 while the upper surface 262 thereof extends generally radially and parallel with the lower surface 260 of trunnion ring flange 24. The outer surface 263 of wedge block 250 is generally parallel to a line tangent to the surface of vessel 10 and has a plurality of bolts 265 affixed to and extending generally parallel from surface 263. Affixed to the lower surface of flange 24 and in alignment with the bolts 265 are a pair of tubular anchor members 252. The bolts 265 respectively extend through anchor members 252 and are secured in position by means of nuts 267 which are threaded on bolts 265 and on the opposite sides of anchor member 252. Disposed at the opposite sides of flange 240 formed integrally therewith are a pair of enlarged bumper portions 269. Secured to the surface 24, trunnion ring 17 and spaced a short distance from the bumper portions 269 are a pair of stop blocks 272. Shim blocks 290 are affixed to stop blocks 272 on the surface thereof adjacent the bumper portions 269. The surface 271 of stop blocks 290 are complementary to the adjacent surfaces 273 of bumper portions 269 whereby rotational movement of the vessel 10 relative to the trunnion ring 17 is prevented.

Those skilled in the art will appreciate that metallurgical vessels of the type illustrated in FIG. 1 are subject to expansion as a result of the heat generated during exothermic reactions which occur when oxygen and other materials are injected into the vessel. Such expansion occurs both in the longitudinal and axial directions and is generally greater than that of the trunnion ring 17 which is commonly water-cooled. As a result, the surface of the vessel adjacent the support assemblies 13, 14, 15 and 16 will move outwardly at an oblique angle relative to the adjacent portion of the trunnion ring. In order to insure that undue stresses are not induced in the mounting brackets 44 and 44', 44*a* and 44*a*', or in the trunnion ring 17 while at the same time insuring that the vessel remains tightly mounted on the trunnion ring 17, the angle of inclination of the surfaces between the mounting brackets 30, 30', 30*a* and 30' and the wedge blocks 52, 52', 52*a* and 52*a*' in the embodiment of FIGS. 1–7 must coincide with the direction in which the adjacent portion of the vessel shell moves. Each angle a or b as seen in FIG. 3 is equal to an angle whose tangent is equal to the change in the distance between the brackets 44 and 44' over the growth in the outer diameter of the adjacent portions of vessel shell 11 during a furnace operation. These relationships are provided by the following expressions:

$$a = \tan^{-1}\left(\frac{\Delta H}{2\Delta R_t}\right)$$

$$b = \tan^{-1}\left(\frac{\Delta H}{2\Delta R_b}\right)$$

$$\Delta H = H\left[B\left(\frac{Tst + Tsb}{2} - Ta\right) + \frac{2750 + N\left[180 + .82\left(\frac{Tst + Tsb}{2} - 455\right)\right]}{E}\right]$$

$$\Delta R_t = R_s\left[B(Tst - Ta) + \frac{2416 + .694N[180 + .82(Tst - 455)]}{E}\right]$$

-continued $$\Delta R_b = R_s\left[B(Tsb - Ta) + \frac{2416 + .697N[180 + .82(Tst - 455)]}{E}\right]$$

where:

| | |
|---|---|
| $R_s$ = Initial outside radius of shell at room temp. | —in. |
| $ts$ = actual thickness of shell | —in. |
| $N = \frac{Rs}{ts}$ | |
| $Tst$ = Temp. of shell at top brkt. during operation | —°F. |
| $Tsb$ = Temp. of shell at bottom brkt. during operation | —°F. |
| $E$ = Young's modulus of elasticity | —Lbs/in.$^2$ |
| $B$ = Coeff. of linear therm. expansion of steel | —in./(in. °F.) |
| $H$ = Effective dist. between top and bottom sup. brkts. | —in. |
| $Rt$ = Radial displacement at top support bracket | —in. |
| $Rb$ = Radial displacement at bottom support bracket | —in. |
| $H$ = Longit. displacement of shell between top and bottom brackets | —in. |
| $Ta$ = Ambient shop temp. | —°F. |

The applicability of these expressions can be illustrated in the example set forth below. In a specific 300 ton BOF vessel the following parameters were employed in calculating the optimum wedge angles:

$R_s$=165.25 in.
$t_s$=3.282 in.
N=165.25 in./3.282 in.=50.35
Tst=580° F.
Tsb=490° F.
E=30×10$^{-6}$ Lbs./in.$^2$
B=6.5×10$^{-6}$ in./(in. °F.) [steel]
H=102 in.
Ta=80° F. (assumed)

From these, the upper and lower wedge angles a and b can be calculated.

$$\Delta H = 102\left[6.5 \times 10^{-6}\left(\frac{580 + 490}{2} - 80\right) + \frac{2750 + 50.35\left[180 + .82\left(\frac{580 + 490}{2} - 455\right)\right]}{30 \times 10^6}\right]$$

$\Delta H$ = .35306 in.

$$\Delta R_t = 165.25\left[\frac{6.5}{106}(580 - 80) + \frac{2614 + .697 \times 50.35\,[180 + .82\,(580 - 455)]}{30 \times 10^6}\right]$$

$\Delta R_t$ = .59054

$$\Delta R_b = 165.25\left[\frac{6.5}{106}(490 - 80) + \frac{2416 + .694 \times 50.35\,[180 + .82\,(490 - 455)]}{30 \times 10^6}\right]$$

$\Delta R_b$ = .49479

$<a = \tan^{-1} = \frac{.35306}{2(.59054)}$ $<a$ = 16.6°

$<b. = \tan^{-1} = \frac{.35306}{2(.49479)}$ $<b.$ = 19.6°

Using the same parameters, but with wedges at the bottom of the assembly only as illustrated in FIGS. 7–9, the wedge angle is determined as follows:

$$<b. = \tan^{-1}\frac{\Delta H}{\Delta R_b}$$

$$<b. = \tan^{-1}\frac{.35306}{.49479}$$

$$<b. = 35.5°$$

t can be seen from the foregoing that in the case of ıpper and lower brackets, the wedge angles are not ıecessarily equal nor in the case of a single lower wedge s it necessarily equal to twice that of either wedge vhen a pair of wedges are employed.

While only a few embodiments of the invention have ›een illustrated and described, it is not intended to be imited thereby, but only the scope of the appended ›laims.

I claim:

1. A metallurgical vessel having a longitudinal axis, a trunnion support at least partially surrounding said vessel and having upper and lower surfaces, upper and lower bracket means mounted on said vessel and being supported on the upper and lower surfaces of said trunnion support respectively, said trunnion support being adopted to be tilted for tilting said vessel about a generally horizontal axis to permit molten metal to be discharged from said vessel, said bracket means supporting said vessel in its upright position and when tilted, said vessel being subject to longitudinal and radial expansion and contraction relative to said trunnion support when molten metal is processed therein whereby the surface of said vessel adjacent the upper and lower surfaces of said trunnion support moves outwardly and away from said trunnion support surfaces at an inclined angle, said lower bracket means engaging said trunnion support along a surface whose angle relative to a line normal to the longitudinal axis of said vessel is substantially equal to:

$$\tan^{-1}\left(\frac{\Delta H}{\Delta R_b}\right)$$

vhere:

$$\text{ıH} = H\left[B\left(\frac{Tst + Tsb}{2} - Ta\right) + \frac{2750 + N\left[180 + .82\left(\frac{Tst + Tsb}{2} - 455\right)\right]}{E}\right]$$

$$\text{ıR}_b = R_s\left[B(Tsb - Ta) + \frac{2416 + .697N[180 + .82\,(Tst - 455)]}{E}\right]$$

nd where:

| | |
|---|---|
| ;s = Initial outside radius of shell at room temp. | in. |
| ; = actual thickness of shell | in. |
| $\text{l} = \frac{Rs}{ts}$ | |
| 'st = Temp. of shell at top brkt. during operation | °F. |
| 'sb = Temp. of shell at bottom brkt. during operation | °F. |
| ; = Young's modulus of elasticity | Lbs/in.$^2$ |
| ; = Coeff. of linear therm. expansion of steel | in./(in. °F.) |
| I = Effective dist. between top and bottom sup. brkts. | in. |
| .Rb = Radial displacement at bottom support bracket | in. |
| .H = Longit. displacement of shell between top and ottom brackets | in. |
| 'a = Ambient shop temp. | °F. |

2. A metallurgical vessel having a longitudinal axis, a trunnion support at least partially surrounding said vessel and having upper and lower surfaces, upper and lower means mounted on said vessel and being supported on the upper and lower surfaces of said trunnion support respectively, said trunnion support being adopted to be tilted for tilting said vessel about a generally horizontal axis to permit molten metal to be discharged from said vessel, said bracket means supporting said vessel in its upright position and when tilted, said vessel being subject to longitudinal and radial expansion and contraction relative to said trunnion support when molten metal is processed therein whereby the surface of said vessel adjacent the upper and lower surfaces of said trunnion support moves outwardly and away from said trunnion support surfaces at an inclined angle, said upper bracket means engaging said trunnion support along a surface whose angle is relative to a line normal to the longitudinal axis of said vessel equal to:

$$\tan^{-1}(\Delta H/2\Delta R_t)$$

and said lower bracket means engages said trunnion support along a surface whose angle relative to said line is substantially equal to:

$$\tan^{-1}\left(\frac{\Delta H}{2\Delta R_b}\right)$$

where:

$$\Delta H = H\left[B\left(\frac{Tst + Tsb}{2} - Ta\right) + \frac{2750 + N\left[180 + .82\left(\frac{Tst + Tsb}{2} - 455\right)\right]}{E}\right]$$

$$\Delta R_t = R_s\left[B(Tst - Ta) + \frac{2416 + .694N[180 + .82(Tst - 455)]}{E}\right]$$

$$\Delta R_b = R_s\left[B(Tsb - Ta) + \frac{2416 + .697N[180 + .82(Tsb - 455)]}{E}\right]$$

and where:

| | |
|---|---|
| $R_s$ = Initial outside radius of shell at room temp. | in. |
| $ts$ = actual thickness of shell | in. |
| $N = \frac{Rs}{ts}$ | |
| $Tst$ = Temp. of shell at top brkt. during operation | °F. |
| $Tsb$ = Temp. of shell at bottom brkt. during operation | °F. |
| $E$ = Young's modulus of elasticity | Lbs/in.$^2$ |
| $B$ = Coeff. of linear therm. expansion of steel | in./(in. °F.) |
| $H$ = Effective dist. between top and bottom sup. brkts. | in. |
| $\Delta Rt$ = Radial displacement at top support bracket | in. |
| $\Delta Rb$ = Radial displacement at bottom support bracket | in. |
| $\Delta H$ = Longit. displacement of shell between top and bottom brackets | in. |
| $Ta$ = Ambient shop temp. | °F. |

3. A metallurgical vessel, a trunnion support at least partially surrounding said vessel and having upper and lower surfaces, upper and lower bracket means mounted on said vessel and being engageable with the upper and lower surfaces of said trunnion support respectively, said trunnion support being adopted to be tilted for tilting said vessel about a generally horizontal axis to permit molten metal to be discharged from said vessel, said bracket means supporting said vessel in its upright position and when tilted, said vessel being subject to longitudinal and radial expansion and contraction when molten metal is processed therein, the surface of said vessel adjacent the upper and lower surfaces of said trunnion support moving outwardly and away from said trunnion support surfaces at an inclined angle, said upper and lower bracket means each having a surface extending in the direction of relative expansion of the adjacent vessel surface, wedge means mounted on each said trunnion support surface and having a complementary angle for engaging the inclined surface of the adjacent bracket means, means for moving said wedge means in a generally radial direction and toward and away from the adjacent surface of said bracket means, each said bracket means having a pair of additional, spaced-apart surfaces extending generally normally to the adjacent surface of said trunnion support, and second means mounted on said trunnion support and engaging said second surfaces to prevent relative rotation of said vessel and said trunnion support.

4. The vessel set forth in claim 3 wherein each said upper and lower bracket means have a pair of spaced-apart surfaces extending in the direction of relative expansion of the adjacent vessel surface, and first and second wedge means mounted on each surface of said trunnion support and each having a complementary angle for respectively engaging one of the surfaces of said pair of surfaces, said pair of additional surfaces being disposed between said first pair of surfaces, said second means being mounted on said trunnion support between said pair of additional surfaces and having complementary surfaces formed thereon.

5. The vessel set forth in claim 4 wherein the surfaces on said second means are spaced from said pair of additional surfaces, and additional wedge means being disposed between the surfaces of said second means and each surface of said second pair of surfaces.

6. The vessel set forth in claim 5 wherein said pair of additional surfaces are formed on the lateral sides of said bracket means, said second means comprising spaced-apart portions each being disposed adjacent one of the lateral sides of said bracket means and having a surface for engaging one of said pair of additional surfaces.

7. A metallurgical vessel, a trunnion support at least partially surrounding said vessel and having upper and lower surfaces, upper and lower bracket means mounted on said vessel and being engageable with the upper and lower surfaces of said trunnion support respectively, said trunnion support being adopted to be tilted for tilting said vessel about a generally horizontal axis to permit molten metal to be discharged from said vessel, said bracket means supporting said vessel in its upright position and when tilted, said vessel being subject to longitudinal and radial expansion and contraction when molten metal is processed therein, the surface of said vessel adjacent the upper and lower surfaces of said trunnion support moving outwardly and away from said trunnion support surfaces at an inclined angle, said bracket means having a surface extending in the direction of relative expansion of the adjacent vessel surface, wedge means mounted on said lower trunnion support surface and having a complementary angle for engaging the inclined surface of the adjacent bracket means, means for moving said wedge means in a generally radial direction and toward and away from the adjacent surface of said bracket means, said bracket means having a pair of additional, spaced-apart surfaces extending generally normally to the adjacent surface of said trunnion support, and second means mounted the lower surface of said trunnion support and engaging said second surfaces to prevent relative rotation of said vessel and said trunnion support.

8. The vessel set forth in claim 7 wherein said lower bracket means has a pair of spaced-apart surfaces each extending in the direction of relative expansion of the adjacent vessel surface, and first and second wedge means mounted the lower surface of said trunnion support and having a complementary angle for respectively engaging one of the surfaces of said pair of surfaces, said pair of additional surfaces being disposed between said first pair of surfaces, said second means being mounted on said trunnion support between said pair of additional surfaces and having complementary surfaces formed thereon.

9. The vessel set forth in claim 8 wherein the surfaces on said second means is spaced apart from said pair of additional surfaces, and additional wedge means being disposed between the surfaces of said second means and each surface of said second pair of surfaces.

10. The vessel set forth in claim 9 wherein said pair of additional surfaces are formed on the lateral sides of said bracket means, said second means comprising spaced-apart portions each being disposed adjacent one of the lateral sides of said bracket means and having a surface for engaging one of said pair of additional surfaces.

* * * * *